US008191319B2

(12) United States Patent
Nark

(10) Patent No.: US 8,191,319 B2
(45) **Date of Patent: *Jun. 5, 2012**

(54) ROOF EDGE CABLE RACEWAY AND METHOD OF FORMING SAME

(75) Inventor: Malcolm Brent Nark, Aurora, CO (US)

(73) Assignee: Hot Edge, Inc., Neponset, IL (US)

( * ) Notice: Subject to any disclaimer, the term of this patent is extended or adjusted under 35 U.S.C. 154(b) by 47 days.

This patent is subject to a terminal disclaimer.

(21) Appl. No.: 12/547,227

(22) Filed: Aug. 25, 2009

(65) Prior Publication Data

US 2011/0049118 A1 Mar. 3, 2011

(51) Int. Cl.
*E04B 7/00* (2006.01)

(52) U.S. Cl. ..... 52/95; 52/11

(58) Field of Classification Search ..... 52/95, 15, 52/96, 94, 97, 173.1, 11, 13; 219/213, 200, 219/201, 520, 521; 248/48.1, 48.2
See application file for complete search history.

(56) References Cited

U.S. PATENT DOCUMENTS

| | | | | |
|---|---|---|---|---|
| 2,699,484 | A | 1/1955 | Michaels | |
| 3,207,211 | A * | 9/1965 | Winterfeldt | 165/47 |
| 3,521,029 | A | 7/1970 | Toyooka et al. | |
| 5,391,858 | A | 2/1995 | Tourangeau et al. | |
| 5,496,005 | A * | 3/1996 | Dieringer | 248/74.2 |
| 5,829,206 | A * | 11/1998 | Bachman | 52/94 |
| 5,836,344 | A | 11/1998 | Hovi, Sr. | |
| 6,225,600 | B1 * | 5/2001 | Burris | 219/213 |
| 6,668,491 | B1 | 12/2003 | Bonerb | |
| 6,759,630 | B1 | 7/2004 | Tenute | |
| 6,852,951 | B2 | 2/2005 | Heise | |
| 7,071,446 | B1 | 7/2006 | Bench | |
| 7,104,012 | B1 * | 9/2006 | Bayram | 52/12 |
| 7,104,013 | B1 | 9/2006 | Gates et al. | |
| 7,287,354 | B2 | 10/2007 | Rivers et al. | |
| 7,448,167 | B2 | 11/2008 | Bachman | |

(Continued)

FOREIGN PATENT DOCUMENTS

JP 2004100302 4/2004

OTHER PUBLICATIONS

Raychem Corporation, IceStop GMK-RC Roof Clip and GM-RAKE Hanger Braket, product brochure, Mar. 1999, 4 pages.

(Continued)

*Primary Examiner* — Branon Painter
(74) *Attorney, Agent, or Firm* — Thompson Coburn LLP

(57) ABSTRACT

A raceway extends along an edge of roof of a structure and is adapted to house a cable, such as an industry standard ice and snow melt heating cable designed, listed and approved for the purpose. An open side of the raceway exposes the cable and allows for the insertion, replacement and inspection of the cable per industry practice. A side of the raceway may have a radiused edge providing added resiliency to springably retain and/or removably secure the cable in raceway. In the case of a heating cable, heat is transferred to the surrounding structure, and may be concentrated at the drip edge to maximize ice melt efficiency. Methods of installation of the raceway are applicable to new construction and retro-fitting existing structures, including drainage systems, bridge structures and other outdoor enclosures, and may be used with many types of roofing materials including asphalt, wood and metal.

4 Claims, 7 Drawing Sheets

U.S. PATENT DOCUMENTS

| | | | | |
|---|---|---|---|---|
| 2001/0025839 | A1 | 10/2001 | Jones | |
| 2005/0139585 | A1 | 6/2005 | Knappmiller | |
| 2006/0037252 | A1* | 2/2006 | Gosse et al. | 52/11 |
| 2006/0096968 | A1 | 5/2006 | Livermore | |
| 2006/0196124 | A1* | 9/2006 | Bachman | 52/12 |
| 2006/0213129 | A1* | 9/2006 | Bachman | 52/11 |
| 2006/0277831 | A1 | 12/2006 | Bachman | |
| 2011/0047892 | A1* | 3/2011 | Nark | 52/95 |
| 2011/0047927 | A1* | 3/2011 | Nark et al. | 52/741.1 |
| 2011/0047930 | A1* | 3/2011 | Nark | 52/745.19 |

OTHER PUBLICATIONS

Raychem Corporation, IceStop product information sheet, Oct. 1984, 1 page.

Chromalox®, Edge-Cutter® Roof De-Icing System product brochure, 2 pages, published on or before Aug. 24, 2008.

Victorian Metal Shingle, Snow Belt System, 3 pages, offered for sale on or before Aug. 24, 2008.

Heat-line Freeze Protection Systems, Edge-Cutter(R) Roof De-icing System, Product Brochure, 2006, 4 pages.

* cited by examiner

ROOF EDGE CABLE RACEWAY AND METHOD OF FORMING SAME

BACKGROUND

This disclosure relates to a roof edge cable raceway that forms a channel at an edge of a roof of a structure for accommodating a cable. The raceway may accommodate a heating cable that melts snow and ice at an edge of a roof of a structure and otherwise prevents ice from accumulating on roof eaves. Although the disclosure is more focused toward a heating cable application, the raceway may also be used for other low voltage wiring applications like running security or audio wires adjacent the eave.

BRIEF DESCRIPTION OF THE DRAWINGS

Further detail of the disclosed embodiments follows in the detailed description below and is shown in the accompanying drawings wherein.

DETAILED DESCRIPTION OF THE EMBODIMENTS

Figure 1:
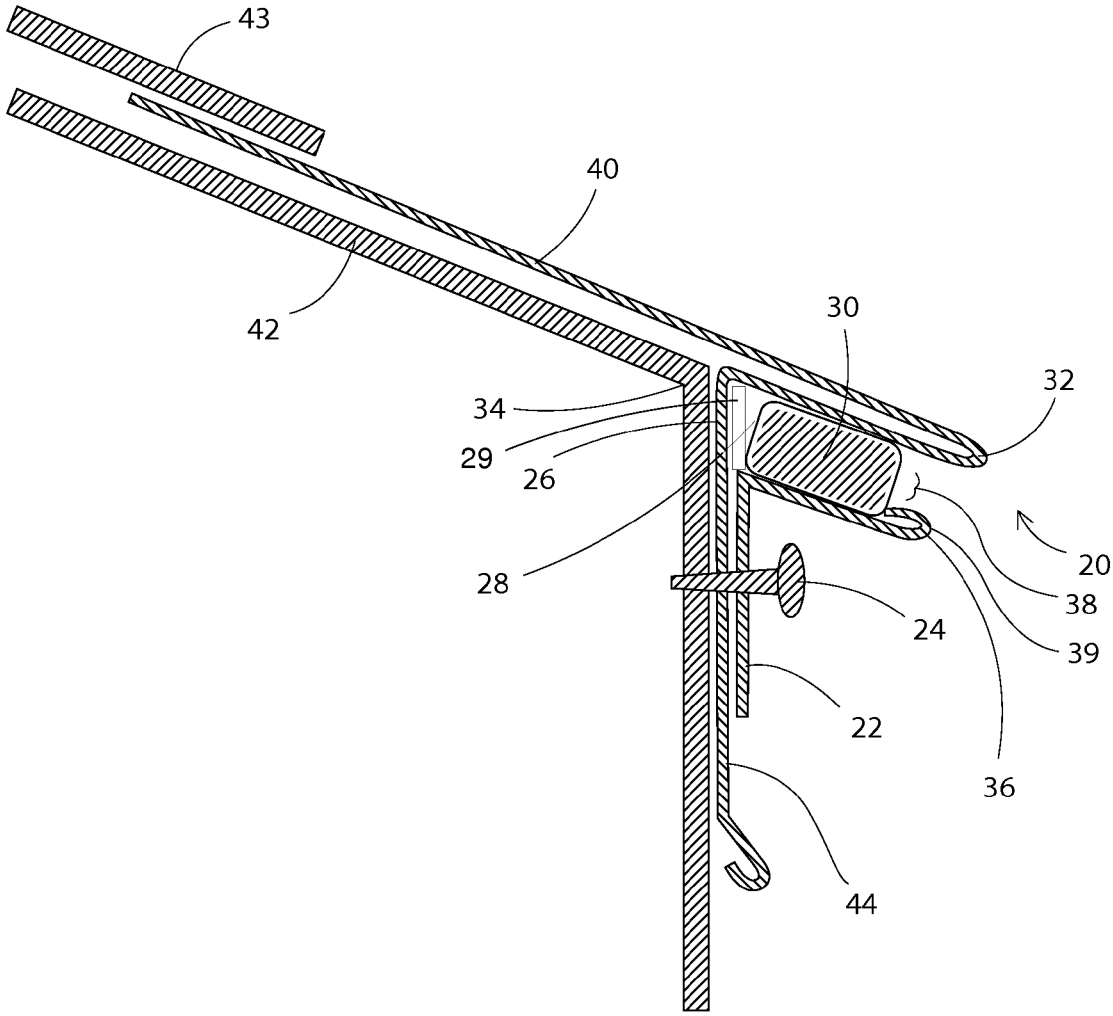
FIG. 1 is a schematic drawing showing a roof edge cable raceway comprising an edge attachment assembled with an overhanging drip edge mounted on an edge of a roof of a structure to form an open channel for housing a heating cable.

Often, ice dams form in very cold climates on the roof of a structure. The heat from inside the structure combined with ambient heat from sunlight will cause snow and ice from the upper roof to melt and drain as water to the roof overhang. Oftentimes, the roof overhang is colder than the upper roof because the underside of the roof overhang is not heated and sees no direct sunlight. This causes the melting snow and ice from the upper roof to refreeze at the roof edge causing an ice dam. An ice dam often causes the draining melting snow and ice to pool. Often, the pooling water backs up behind the ice dam and leaks into the structure causing damage to walls, ceilings, insulation, and electrical systems. The water can also lead to environmental issues such as mold and mildew. Often, an ice dam causes the formation of icicles at an edge of a structure that cause a hazard.

Generally speaking, correct roof drainage requires about a three-quarter inch additional overhang of roofing material from the structure front face (facia board) to ensure drainage water flows into a gutter positioned adjacent to an edge of a roof of a structure. If the overhang is too short, melting snow and ice, and rain water will flow behind the gutter leading to rotted wood sheathing and facia, stained siding, soil erosion at the foundation below and, potentially, flooded basements. In some construction techniques, asphalt roofs often have a three-quarter inch overhang of shingles to drain water into the gutters. In some construction techniques, shingle or shake roofs have a metal drip edge that acts as a support for the extended shingles or shakes, and the shingles or shakes completely cover the metal drip edge.

The roof edge cable raceway with an associated heating cable installed therein as described below prevents the formation of ice dams while improving the visual appearance of the structure in which the apparatus and heating cable is installed. The roof edge cable raceway described below may be used with many roofing types, including metal, raised seam metal, corrugated metal, shake, and conventional asphalt shingles, and may be used on residential housing, industrial buildings, bridges, electrical transformers, outdoor cabinets, enclosures and other structures. As described below and shown in FIG. 1-7, the roof edge cable raceway forms a channel that extends along an edge of a roof of a structure. When a heating cable is installed in the channel, the effect of heat transfer from the cable to a heat conductive portion of the drip edge heats the edge of the roof sufficiently to prevent or melt any ice dams, thereby enhancing drainage of melting snow and ice and preventing the formation of icicles. As described below and shown in FIG. 1-7, the roof edge cable raceway may comprise an edge attachment fitted to a drip edge, for instance, an existing overhanging drip edge already installed on an edge of a roof of a structure, or may comprise a drip edge, or an overhanging style drip edge, with an integrally formed (if not monolithically formed) open channel structure.

The roof edge cable raceway and open channel structure may be configured to house a resistance-type heating cable, or a self-regulating heating cable, or other low voltage style cabling applications, for instance, cables used for lighting, security cameras or audio speakers. Generally speaking, in a heating cable application as described below, the heating cable must have a snug fit in the channel to maximize heat transfer from the heating cable to the roof. Although not necessary, the entire roof edge cable raceway may be formed from a heat conductive material to simplify construction. In the alternative, the side of the channel adjacent the edge of the roof, and the portion of the roofing materials in contact therewith may be formed from a heat conductive material to allow heat transfer to the area adjacent the roof edge, or in an alternate use where heat transfer is not critical, i.e., low voltage style cabling applications, the raceway may be formed of plastic or PVC materials.

As an example, and not in any limiting sense, FIGS. 1-5 show various embodiments of a roof edge cable raceway 20 used to form an open channel structure along an edge of a roof of a structure in which a heating cable is housed. The heating cable transfers heat directly to a heat conductive portion of the roof edge cable raceway preventing ice build-up at the drip edge and the formation of ice dams on the roof edge. Heat from the cable is concentrated at the drip edge. The open channel structure allows ready replacement and inspection of the heating cable. The channel is defined by channel sides that preferably extend along the length of the channel and define an opening into the channel. The channel may extend along the entire length of the roof edge or a portion of the roof edge desired to be heating.

FIG. 1 shows a roof edge cable raceway 20 comprising an edge attachment 22 assembled with mechanical fasteners 24 to an overhanging drip edge 26 to form a channel 28 for housing a heating cable 30. The channel 28 has a first side 32 positioned adjacent a roof edge 34 and a second channel side 36 spaced therefrom. Together, the channel sides 32,36 define an opening 38 for the channel 28. The open channel 28 allows replacement and inspection of the heating cable 30 through the opening 38 from a position in front of the channel opening. As shown in FIG. 1, the second channel side 36 may be formed by mounting the edge attachment 22 at a position sufficient to allow the cable 30 to be visible in the opening 38 of channel from a position in front of the channel while allowing the sides of the channel to be urged against the cable with a snug fit to removably secure the cable in the channel. The second channel side 36 may comprise a radiused outer edge 39. The radiused outer edge provides additional resiliency to springably retain and/or removably secure the heating cable in the channel. The radiused outer edge also assists installation personnel in installing the heating cable in the channel. Although the radiused outer edge 39 is shown in FIG. 1, the distal edge of the edge attachment may also be flat without a radius.

As described above, the edge attachment functions as a biasing member urging the heating cable upward in FIG. 1 toward the channel first side. However, this may be reversed and the channel first side may function as a biasing member urging the heating cable downward in FIG. 1 toward the edge attachment. In the alternative, the biasing member may be a separate resilient member that is inserted in the channel, for instance, below the cable to urge the cable upward in FIG. 1 toward the channel first side. The separate resilient member may comprise a wave form elongated member disposed in the channel adjacent one or both of the channel sides; a foam rubber material disposed in the channel adjacent one or both of the channel sides; rubber, silicone, or plastic inserts that extend along the channel sides and/or engage one or both of the channel sides; or rubber, silicone, or plastic inserts periodically spaced along the length of the channel sides, for instance, in openings in one or both of the channel sides. The biasing member may be made from a heat conductive material to maximize heat transfer from the cable to the adjacent roof structure. The drawings show a relatively simplified construction of the raceway, involving less components, where one or both of the channel sides is formed to be resiliently deflected or springably moved to allow the heating cable to be removably secured in the channel.

The first channel side (i.e., the channel side adjacent the roof edge) 32 has a roof engagement portion 40 extending therefrom adapted to overlie and be secured to a portion 42 of the roof of the structure adjacent the roof edge 32. As shown in FIG. 1, the roof engagement portion 40 may also extend beyond the roof edge to form the overhanging portion of the drip edge. While the roof engagement portion of FIG. 1 has an exposed lower part with shingles or shakes 43 covering an upper part of the roof engagement portion, additional row(s) of shingles or shakes may cover the lower exposed part of the roof engagement portion and may extend to or beyond the roof edge thereby covering a majority or all of the roof engagement portion, as may be desired depending upon the construction techniques used. A fascia mounting portion 44 may extend from the first channel side 32 in a direction generally transverse to the roof engagement portion 40, and the edge attachment 22 forming the second channel side may be mounted thereto.

The overhanging style drip edge (or drip edge) may comprise a pre-existing installation on the edge of the roof of the structure, thus allowing one to secure the edge attachment to the overhanging drip edge to form the channel, for instance in a retrofitting type of application. In this regard, the edge attachment 22 may comprise a member with a generally L-shaped cross-section that is mounted below the overhanging drip edge with a space therebetween that forms the channel 28. While FIG. 1 shows the use of mechanical fasteners 24 to secure the edge attachment to the facia board to form the channel, other methods may be used, including providing the facia mounting portion of the overhanging drip edge with a system of locking tabs that cooperate with the edge attachment to secure the edge attachment in the proper location to form a channel suitable for housing the heating cable.

Using an edge attachment comprising a member having a generally L-shaped cross-section allows flexibility for the scope of work to be performed by on-site metal fabricators. For instance, on-site metal fabricators may form the edge attachment and install the edge attachment on the existing structure to form the open channel at the necessary dimensions to snugly fit the heating cable in the channel, and then the heating cable may then be installed in the open channel. To assist in mounting the edge attachment at the required spacing so that the channel accommodates the heating cable with a snug fit, the generally "L"-shaped edge attachment 22 may have a removable, and/or detachable (i.e., "knock-out" style) tab 29 projecting from its corner. In the alternative, the heating cable may be positioned adjacent the roof edge and then the edge attachment installed with the cable in place. As another example, the edge attachment may be mounted to an preexisting F-style overhanging drip edge installed on the structure. In the alternative, on site-metal fabricators may install the F-style overhanging drip edge and then the edge attachment. In the alternative, on-site metal fabricators may bend sheets of flat or rolled flashing materials as necessary to form and then install an overhanging drip edge and edge attachment. Various other combinations and sequences are also possible depending upon whether the work involves new construction, or remodeling or retrofitting of an existing structure.

Generally, the drip edges, such a F-style overhanging drip edges, comprise aluminum materials, for instance, extruded aluminum materials. Flashing generally also comprises aluminum sheets or rolls of aluminum. By closely mounting the edge attachment to the overhanging drip edge, the edge attachment and/or overhanging drip edge may be resiliently deflected or springably moved slightly to allow the heating cable to be snugly fit therebetween. As discussed before, forming a radiused outer edge 39 on the edge attachment provides additional resiliency for snugly retaining and/or removably securing the heating cable in the channel. Additionally, when replacement of the cable is needed, the cable may be removed by pushing the channel sides to an apart position an amount sufficient to release the cable from the channel through the opening without mechanical deformation of the edge attachment or drip edge. A new heating cable may be then be readily installed using the existing raceway by moving the channel sides to an apart position to allow the new heating cable to inserted through the opening into the channel. Alternatively, mechanical fasteners holding the edge attachment in place may be removed (or loosened if the edge attachment is provided with elongated or "peanut-shaped" holes) thereby allowing the heating cable to be removed. A new heating cable may then be installed in the channel using one of the aforementioned methods.

The tight contact between the heating cable and the channel sides allows heat transfer through the heat conductive materials (i.e., aluminum) from the cable to a heat conductive portion of the roof edge cable raceway to a portion of the roof adjacent the drip edge, thus enabling the drip edge to be heated sufficiently to prevent ice formation at the edge of the roof of the structure. However, it is not necessary that the edge attachment be formed from a heat conductive material. Rather, the roof engagement portion and the channel first side may be made from a heat conductive material to allow heat transfer from the heating cable to the underside of the roofing materials for heating at the roof edge, and the edge attachment as well as the fascia engagement portion may be made from a different material.

Figure 2:
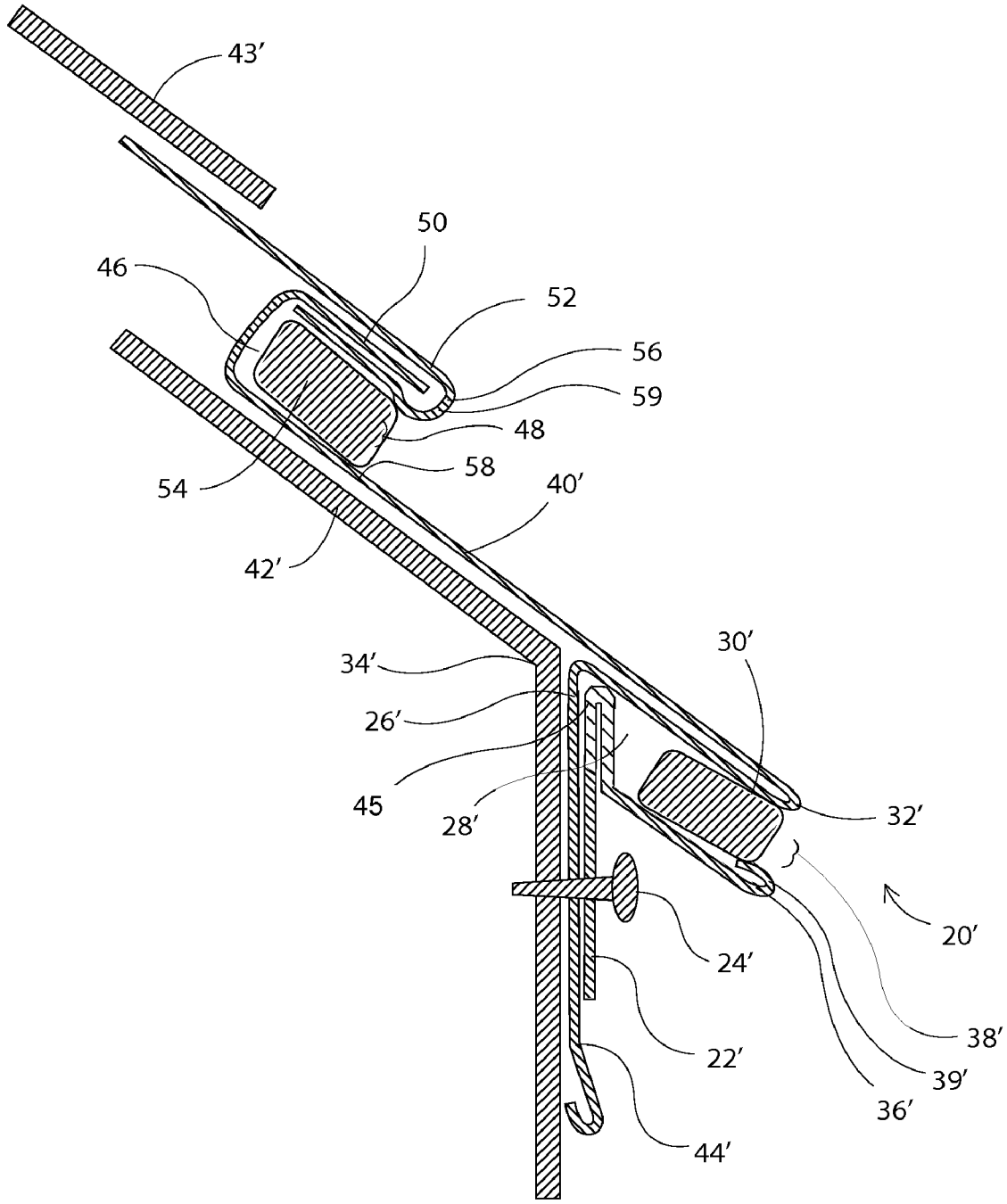
FIG. 2 is a schematic drawing showing an alternate embodiment of a roof edge cable raceway comprising the edge attachment of FIG. 1 and an overhanging drip edge with a second channel formed in a roof engagement portion of the overhanging drip edge for housing a second heating cable.

FIG. 2 shows an alternate embodiment of a roof edge cable raceway having the same basic arrangement of that of FIG. 1. In that regard, elements appearing in FIG. 2 that are related to those of FIG. 1 will be indicated with a (').. As with the embodiment of FIG. 1, the edge attachment 22' is assembled with mechanical fasteners 24' to the fascia mounting portion 44' of the overhanging drip edge 26' to form the channel structure 28' for springably retaining and/or removably securing the heating cable 30', and the channel has a first side 32' positioned adjacent the roof edge 34' and a second side 36' spaced therefrom defined by the mounted position of the edge attachment 22'. The second channel side 36' may have a radiused outer edge 39'. Together the first and second sides 32',36' define an opening for the channel. As with the embodiment of FIG. 1, the channel first side 32' has a roof engagement portion 40' extending therefrom up the roof 42' and beyond the roof edge 34' to form the overhanging portion of the drip edge. Also as with the embodiment of FIG. 1, shingles or shakes 43' do not extend to the roof edge and a lower part of the roof engagement portion is exposed. Also, as with the embodiment of FIG. 1, a fascia mounting portion 44' may extend from the channel first side in a direction generally transverse to the roof engagement portion with the edge attachment 22' forming the second channel side may be mounted thereto.

However, in the embodiment of FIG. 2, a spacer 45 is integrally formed on the edge attachment 22' to assist in locating the edge attachment at the proper spacing to form the channel opening 38' to accommodate the heating cable, rather than the tab of FIG. 1. Although not shown in the drawings, the generally "L"-shaped edge attachment of FIG. 1 may be similarly configured with an integrally formed spacer. Also, in the embodiment of FIG. 2, the roof engagement portion 40' is provided with a second channel 46 having an opening 48 at an upper portion 50 of the roof engagement portion. The opening 46 of the channel 48 may be formed by overlapping the upper portion 50 of the roof engagement portion 40'. An additional section of flashing material 52 may interlock with the upper portion 50 in the second channel 46 and may extend under the roofing materials 43' (i.e., shingles, shakes, etc.) (not shown) a further distance up the roof 42' from the edge 34' of the roof of the structure. The second open channel 46 a houses a second heating cable 54 to increase the area of snow and ice that may be melted at the edge of the roof of the structure. Channel sides 56,58 define the second channel opening 48, and at least one of the sides 56,58 of the second channel is sufficiently resilient to allow the heating cable 54 to be inserted through the opening into the second channel 46 in manner to allow the heating cable to be secured in the second channel with the heating cable being visible through the opening from a position in front of the opening of the second channel. For instance, as shown in FIG. 2, the second channel first side 56 may have a relatively large radiused edge 59 to assist in providing added resiliency for the second channel first side to springably retain and/or removably secure the second heating cable 54 in the second heating channel. This radius feature may be reversed and provided on the second channel second side. Although FIG. 2 shows the added flashing 52 interlocking with the roof engagement portion 40', it should be appreciated that the second channel 46 may be monolithically formed with the roof engagement portion of the overhanging drip edge and/or monolithically formed with the added flashing. Additionally, it should be appreciated that a biasing member may be provided in a manner as previously described in one or both of the first and second channels to assist in removably securing a cable therein.

Figure 3:
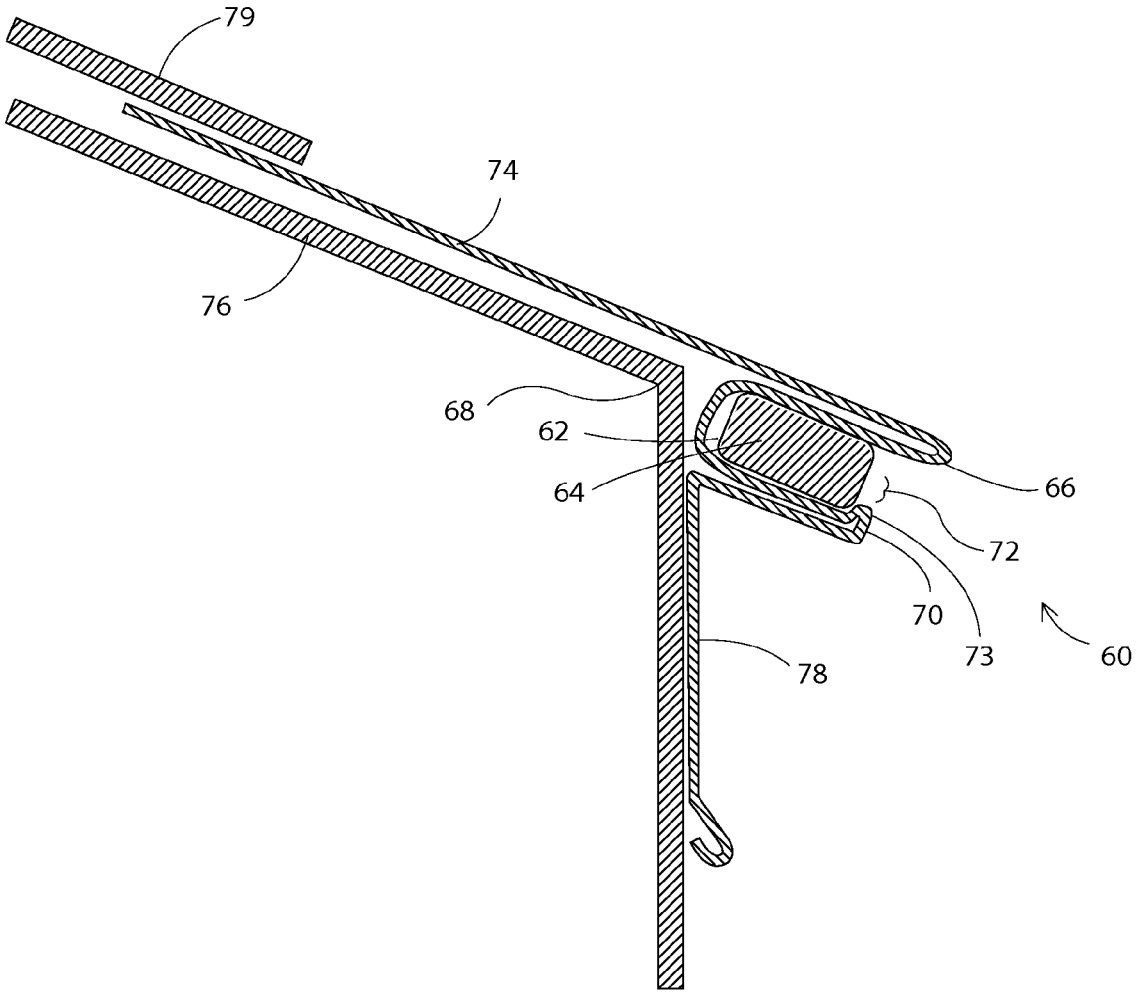
FIG. 3 is a schematic drawing showing an alternate embodiment of a roof edge cable raceway mounted on an edge of a roof of a structure with a monolithically formed open channel for housing a heating cable.

FIG. 3 shows a roof edge cable raceway 60 with a monolithically formed channel 62 that is pre-formed for a heating cable 64. The channel 62 has a first side 66 positioned adjacent a roof edge 68 and a second side 70 spaced therefrom. Together the channel sides 66,70 define an opening 72 into the channel 62, and one or more of the channel sides may be sufficiently resilient to be springably moved to allow insertion of the heating cable 64 through the opening 72 into the channel 68 in a manner to allow securing the heating cable in the channel with the heating cable being visible through the opening from a position in front of the opening. The resiliency of the channel sides also allows replacement of the heating cable without deformation of the channel. The channel second side 70 may have a relatively large radiused edge 73 to assist in providing added resiliency for the channel second side to springably retain and/or removably secure the second heating cable 54 in the second heating channel. It should be appreciated that a biasing member may be provided in a manner as previously described in the channel to assist in removably securing a cable therein. The roof edge cable raceway 60 may comprise a roof engagement portion 74 that is adapted to overlie and be secured to a portion 76 of a roof of the structure on the channel first side, and a facia engagement portion 78 extending from the channel second side. The roof engagement portion may also extend beyond the roof edge 68 to form an overhanging roof edge. Preferably, the roof engagement portion 74, the fascia engagement portion 78, and the channel sides 66,70 are monolithically formed. In the alternative, the roof engagement portion and the channel first side may be made from a heat conductive material to allow heat transfer from the heating cable to the underside of the roofing materials 79 for heating at the roof edge, and the fascia engagement portion may be made from a different material. The embodiment of FIG. 3 may also be provided with a second channel (not shown) on the roof engagement portion similar in arrangement to that of FIG. 2 or a second channel monolithically formed with the roof engagement portion in the manner mentioned previously. Also, the embodiment of the roof edge cable raceway of FIG. 3 may be extruded as a monolithic member or may be formed on-site by metal fabricators bending flashing as needed into the form as shown FIG. 3 in the manner mentioned previously.

Figure 4:
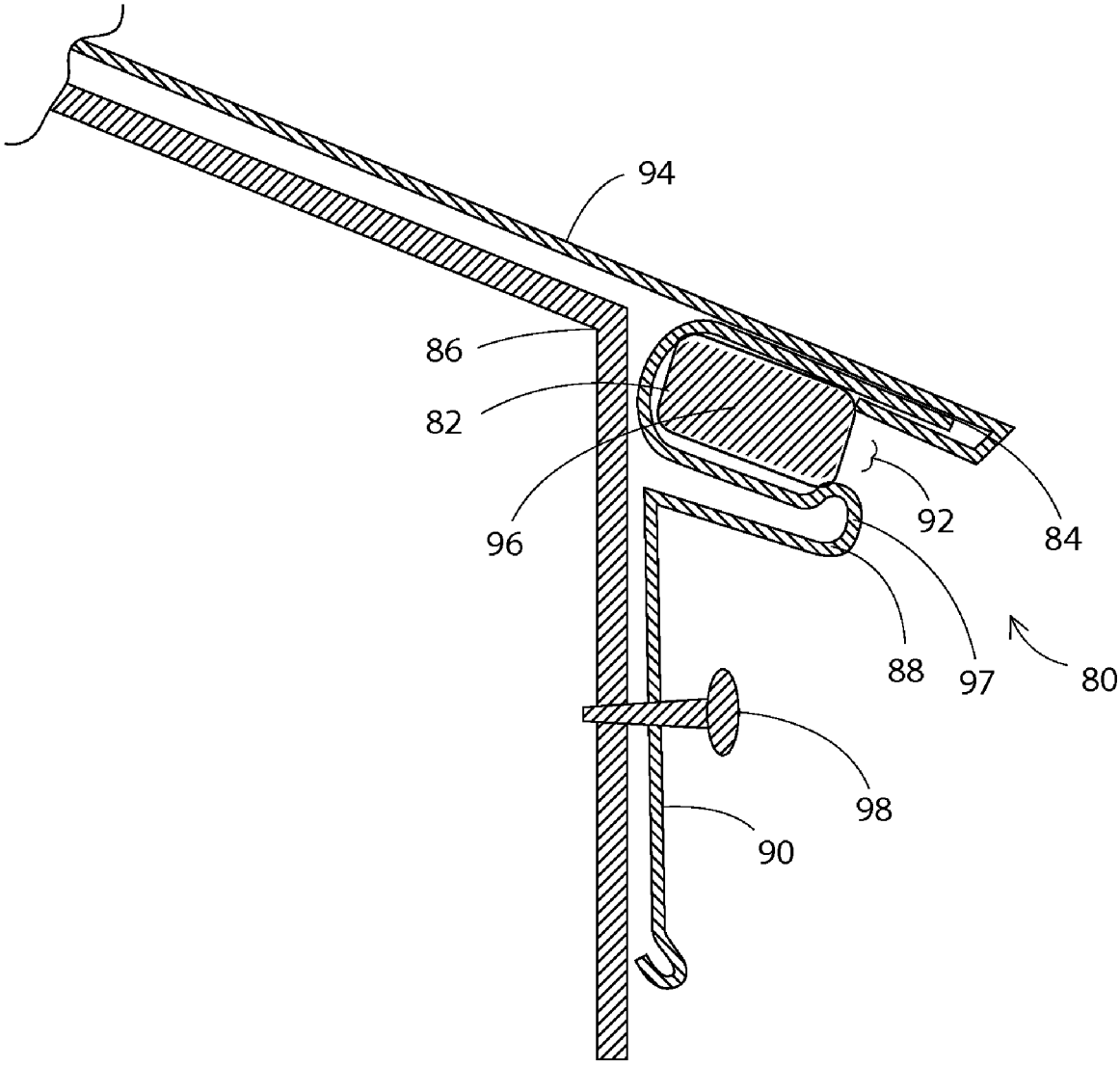
FIG. 4 is a schematic drawing showing an alternate embodiment of roof edge cable raceway mounted on an edge of a roof of a structure with a J-shaped cross-section adapted for housing a heating cable.

FIG. 4 shows an alternate embodiment of a roof edge cable raceway 80 comprising a open J-style channel. In the embodiment shown in FIG. 4, a channel 82 is formed monolithically with a first side 84 of the channel adjacent a roof edge 86 and an opposite, second side 88 of the channel having a facia engagement portion 90 extending therefrom. Together, the channel sides 84,88 define an opening 92 extending along the length of the channel 82. The channel first side 84 may engage roofing materials 94, for instance, a metal roof. As described previously, one or more of the channel sides 84,88 may be sufficiently resilient to be springably moved to allow insertion of a heating cable 96 into the channel 82 through the opening 92, while retaining the heating cable in the channel with a snug fit sufficient to allow heat from the cable to transfer to the channel and roof to prevent the formation of an ice dam. The channel second side may be provided with a large radiused outer edge 97 to assist in providing added resiliency for the channel second side to springably retain the heating cable 96 in the channel. The J-style open channel also allows the heating cable to be removably secured in the channel thereby allowing inspection and/or replacement at a later date as needed. It should be appreciated that a biasing member may be provided in a manner as previously described in the channel to assist in releasably securing a cable therein. As shown in FIG. 4, the channel and fascia engagement portion are monolithically formed. However, it should be appreciated that the first channel side may be made from a heat conductive material to allow heat transfer to the roofing materials with the second channel side and/or fascia engagement portion made from a different material. Also, the embodiment of the roof edge cable raceway of FIG. 4 may be extruded as a monolithic member or may be formed on-site by metal fabricators bending flashing as needed into the form as shown in FIG. 4. The roof edge raceway of FIG. 4 may be secured to the structure being using mechanical fasteners 98 at the fascia engagement portion 90.

Figure 5:
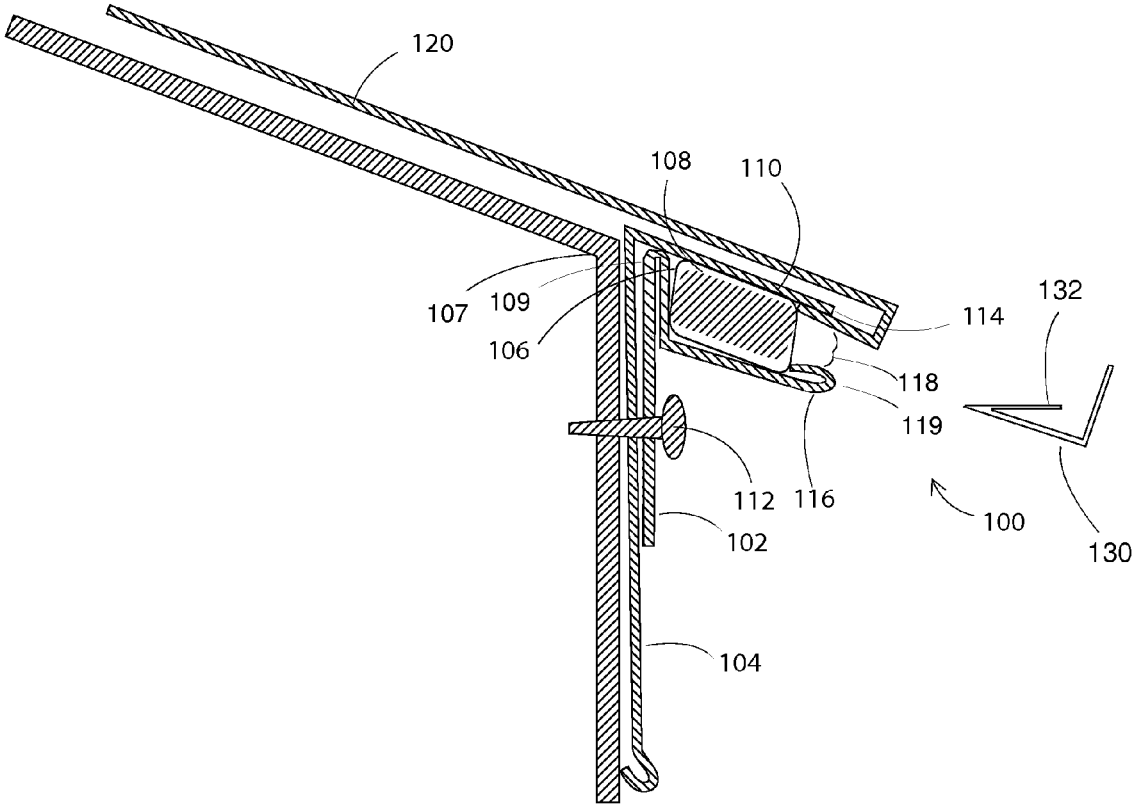
FIG. 5 is a schematic drawing showing an alternate embodiment of a roof edge cable raceway comprising an edge attachment secured to existing facia flashing provided on a structure to form a channel adapted for housing a heating cable.

FIG. 5 shows an alternate embodiment of a roof edge cable raceway 100 wherein an edge attachment 102 is assembled with existing facia flashing 104 provided on a structure in a manner to form a channel 106 at an edge 107 of the roof of the structure for accommodating a heating cable 108. As with embodiment of FIG. 2, the edge attachment 102 of FIG. 5 may be provided with a spacer 109 to assist in locating the edge attachment at a spacing corresponding to the size of the heating cable. As shown in FIG. 5, the fascia flashing 104 comprises a generally "L"-shaped member with a roof engagement portion 110. The edge attachment 102 may also comprise a member having a generally L-shaped cross-section that may be secured to the structure and/or fascia flashing 104 with mechanical fasteners 112. In the alternative, the fascia flashing and edge attachment may have a system of cooperating tabs and notches to allow the edge attachment to be positioned on the fascia flashing in a manner to create a channel sufficient to house the heating cable in a manner as described previously. As shown in FIG. 5, the roof engagement portion 110 of the existing fascia flashing 104 forms a channel first side 114, and the mounted position of the edge attachment defines a channel second side 116. Together, the channel sides define an opening 118 for the channel 106. The first channel side 114 may engage roofing materials 120, for instance, a metal roof. At least one of the sides of the channel, for instance, the side of the channel formed by the edge attachment, may be sufficiently resilient to allow it to be springably moved to allow insertion of the heating cable in the channel in a manner to allow securing the heating cable in the channel with the heating cable visible from the opening. As shown in FIG. 5, the channel second side may be provided with a large radius edge 119 to assist in providing added resiliency for the second side in snugly retaining the heating cable in the channel. The spacer 109 assists in setting the spacing to allow the heating cable to be snugly fit in the channel. The open channel of FIG. 5 also allows the heating cable to be inspected and/or replaced at a later date as needed, using one or more of the methods discussed above. Again, a snug fit ensures maximum heat transfer to the flashing and the roof structure to provide adequate melting at the roof edge. However, it should be appreciated that a biasing member may be provided in a manner as previously described in the channels to assist in releasably securing a cable therein. In the embodiment of FIG. 5, the engagement portion 110 of the fascia flashing may be made from a heat conductive material and the edge attachment may be made from a different material.

FIG. 5 also shows a cover 130 that may be provided to cover the opening of the channel and also a biasing member 132 to urge the heat cable upward in the channel. The cover 130 and biasing member 132 shown in FIG. 5 may be added to any of the channels of the preceding Figures. After the heating cable is installed, the cover 130 may be fitted into the channel so the biasing member 132 fits under the cable and pushes the cable against the roof engagement portion. Preferably, the biasing member provides a tight fit for the cable against the roof engagement portion thereby maximizing heat transfer to the roof engagement portion and drip edge. Preferably, the cover 130 and biasing member 132 are made from a heat conductive material so as to maximize heat transfer to the roof engagement portion and drip edge and to reduce the effects of air being trapped between the cable and the roof engagement portion and drip edge that may otherwise reduce the rate of heat transfer.

Figure 6:
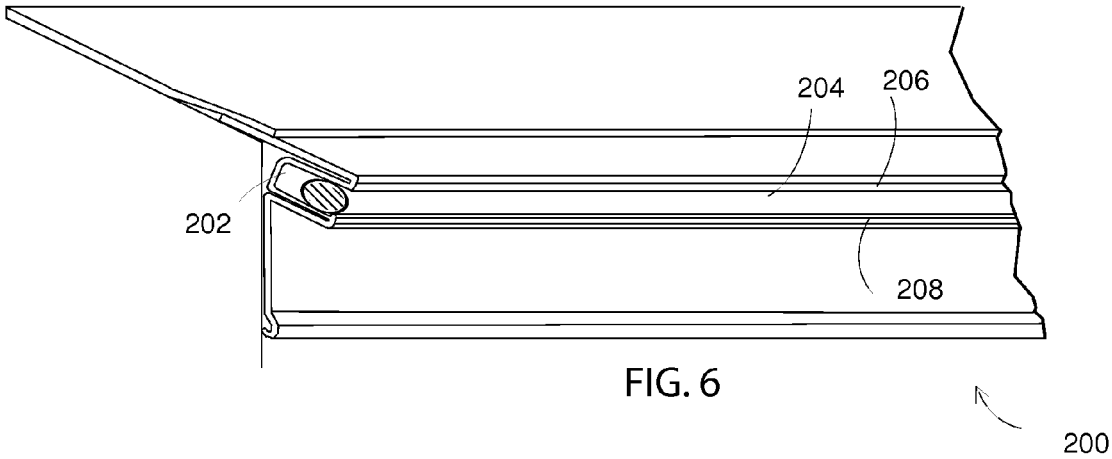
FIG. 6 is a schematic drawings showing a partial edge view of a channel formed along an edge of a roof of a structure using any one of the roof edge cable raceways shown in FIGS. 1-5 with a heating cable disposed therein.

FIG. 6 shows a schematic drawing of roof edge cable raceway 200 with an open channel structure 202 with a heating cable 204 disposed therein and channel sides 206,208 springably urged against the cable 204 to removably secure the cable in the channel.

Figure 7:
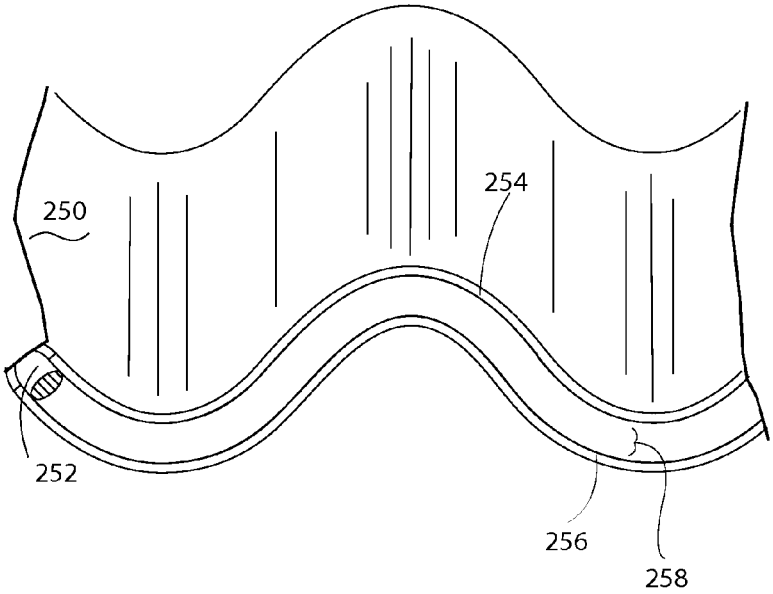
FIG. 7 is a schematic drawing showing a partial edge view of a channel formed along an edge of a corrugated roof of a structure with a curvilinear roof edge cable raceway with a heating cable disposed therein.

FIG. 7 shows a corrugated roof 250 with a raceway 252 formed on its edge for housing a heating cable 254. In the embodiment of FIG. 7, corrugated roofing materials 256 that have curved features that match the corrugated roof 250 of the structure are secured to the structure below the edge of the existing corrugated roof with a space 258 sufficient in dimension to house the heating cable 254 therebetween.

Figure 8:
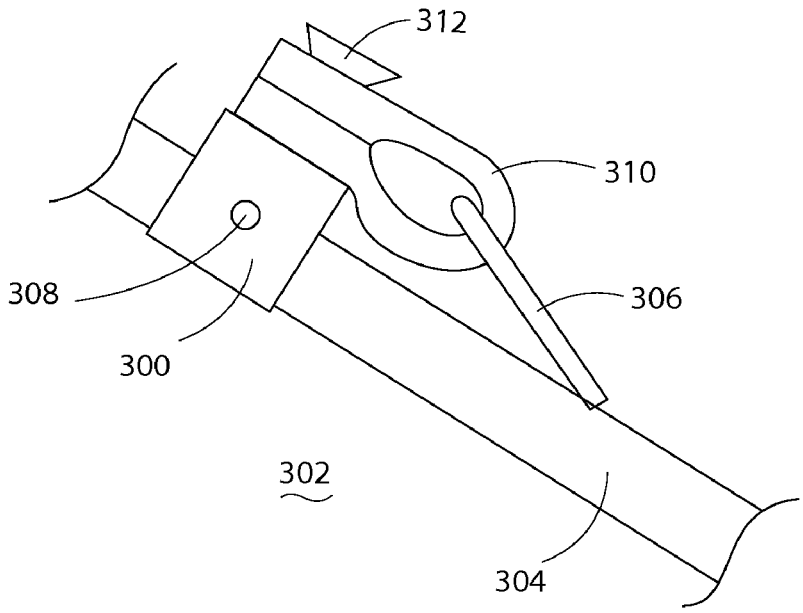
FIG. 8 is a schematic drawing of a clamping mechanism used to secure a heating cable to a point on a seam of a metal roof.

Each of the heating cables described herein may be used in connection with a roof clamp 300 in a system shown schematically in FIG. 8. Some roofs 302 have raised metal seams 304 that require protection from water leaking into the seam and penetrating the structure. Oftentimes, a heating cable 306 is extended from the drip edge up to a point on the roof past the interior wall to provide a drain path for melted snow or ice. For instance, a heating cable may extend around a fireplace or in the areas where different peaks of a roof converge. On raised seam metal roofs as shown in FIG. 8, the clamp 300 may be secured to the roof with mechanical fasteners 308. On conventional shingle or shake roofs, the clamps may be adhered to the roof with glue. A loop 310 is secured to the clamp with a mechanical fastener 312 with the heating cable 306 passing through the opening of the loop. The roof edge cable raceway and heating cable described herein may be used in connection with one or more of heating cable clamps 300 in the illustrative example shown in FIG. 8. Accordingly, a portion of the heating cable may exit the roof edge cable raceway channel through the opening and extend up the roof to the clamp before returning down the roof to the roof edge and back into the roof edge cable raceway channel through the opening. Thus, it is not necessary that the entire heating cable be housed in the roof edge cable raceway channel.

Figure 9:
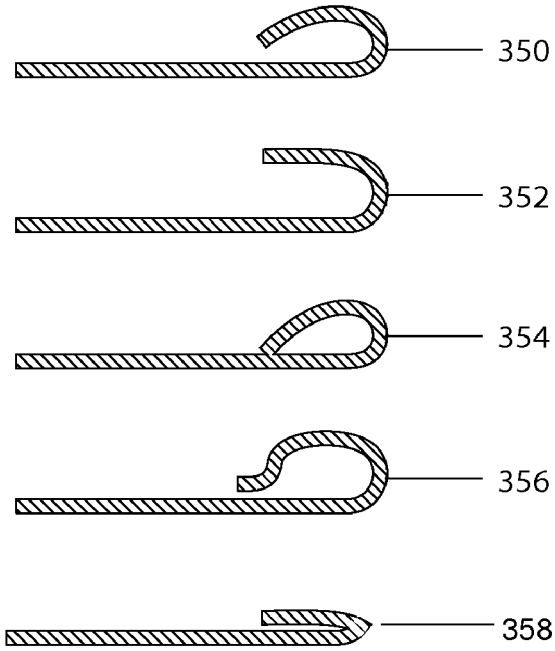
FIG. 9 shows alternate embodiments of radiuses for sides of the channel or end edges of any of the edge attachments described herein.

FIG. 9 shows alternate embodiments of radius styles that may be provided on one or more of the sides of the channel for added resiliency to springably retain and/or removably secure the heating cable in the channel. The radius or hem style may also be provided on the edge of any of the edge attachments, fascia mounting portions, or roof engagement portions. For instance, the edge attachment comprising a generally "L"-shaped cross section may have a distal edge folded back onto itself with a radius in one of the exemplary styles 350,352, 354,356,358 thereby forming a channel second side with added resiliency. As mentioned previously, providing one or more channel sides with a radiused edge facilitates installation, although one or more of the channel side may be flat. The distal end of the fascia mounting portion may also have a radius edge in one of the exemplary styles 350,352,354,356, 358 to direct drainage away from the structure.

While specific embodiments have been described in detail in the foregoing detailed description and illustrated in the accompanying drawings, those with ordinary skill in the art will appreciate that various modifications and alternatives to those details could be developed in light of the overall teachings of the disclosure. Accordingly, the particular arrangements disclosed were meant to be illustrative only and not limited as to the scope of the invention which is to be given the full breadth of the appended claims and any equivalents thereof.

What is claimed is:

1. A roof edge cable raceway system adapted to be installed along an edge of a roof of a structure, the roof edge cable raceway system having a channel with opposing sides that extend along a length of the channel and at least in part define an opening into the channel extending along the length of the channel, a first of the channel sides adapted to be positioned adjacent the edge of the roof of the structure and a second of the channel sides being spaced from the first channel side by a width of the channel, the roof edge cable raceway system comprising first and second separate members distinct from one another and assembled together to form the roof edge cable raceway system, the first separate member comprising a roof engagement portion being adapted to abut a portion of the roof of a structure adjacent the roof edge and forming the first channel side in the roof edge cable raceway system, the second separate member comprising a biasing member having a generally "L"-shaped cross-section and forming the second channel side in the roof edge cable raceway system;

wherein in forming the roof edge cable raceway system, the biasing member is adapted to releasably engage a cable disposed in the channel, and the biasing member is movable in a first direction to allow insertion of the cable through the opening into the channel and a second direction to allow removably securing the cable in the channel with the cable visible through the opening from a position in front of the opening, wherein the biasing member has a projection, the projection having a length;

wherein in forming the roof edge cable raceway system, the biasing member is adjustably attached to the roof engagement portion to form the channel, the channel adapted to accommodate the thickness of a heating cable; and wherein the projection abuts the roof engagement portion and sets the opening of the channel when the first and second separate members are assembled together to form the roof edge cable raceway system.

2. The roof edge cable raceway system of claim 1, wherein the roof engagement portion comprises an extrusion of heat conductive material.

3. A roof edge cable raceway system adapted to be installed along an edge of a roof of a structure, the roof edge cable raceway system having a channel with opposing sides that extend along a length of the channel and at least in part define an opening into the channel extending along the length of the channel, a first of the channel sides adapted to be positioned adjacent the edge of the roof of the structure and being formed from a heat conductive material, the second of the channel sides being spaced from the first channel side by a width of the channel, the channel sides having sufficient resiliency to allow removably securing a heating cable therein without deformation of the channel sides, the roof edge cable raceway system comprising first and second separate members distinct from one another and assembled together to form the roof edge cable raceway system, the first separate member comprising a roof engagement portion forming the first channel side and being adapted to abut a portion of the roof of a structure adjacent the roof edge in forming the roof edge cable raceway system, the second separate member comprising an edge attachment adapted to be adjustably attached to roof engagement portion to form the second channel side in forming the roof edge cable raceway system;

wherein the edge attachment comprises a member with a generally "L"-shaped cross-section;

wherein the edge attachment has a projection, the projection having a length;

wherein in forming the roof edge cable raceway system, the edge attachment is adjustably attached to the roof engagement portion to form the channel, the channel adapted to accommodate the thickness of a heating cable; and wherein the projection abuts the roof engagement portion and sets the spacing of the channel when the first and second separate members are assembled together to form the roof edge cable raceway system.

4. The roof edge cable raceway system of claim 3, wherein the roof engagement portion comprises an extrusion of the heat conductive material.

* * * * *